US009522423B2

(12) United States Patent
Rinaldi et al.

(10) Patent No.: US 9,522,423 B2
(45) Date of Patent: Dec. 20, 2016

(54) CRYSTALLIZER FOR CONTINUOUS CASTING

(71) Applicant: DANIELI & C. OFFICINE MECCANICHE SPA, Buttrio (IT)

(72) Inventors: Marco Rinaldi, Udine (IT); Marco Mauro Motta, Udine (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 214 days.

(21) Appl. No.: 14/367,110

(22) PCT Filed: Dec. 21, 2012

(86) PCT No.: PCT/IB2012/002769
§ 371 (c)(1),
(2) Date: Jun. 19, 2014

(87) PCT Pub. No.: WO2013/093605
PCT Pub. Date: Jun. 27, 2013

(65) Prior Publication Data

US 2014/0374971 A1 Dec. 25, 2014

(30) Foreign Application Priority Data

Dec. 23, 2011 (IT) ..... UD2011A0211

(51) Int. Cl.
*B22D 11/124* (2006.01)
*B22D 11/041* (2006.01)
(Continued)

(52) U.S. Cl.
CPC ..... *B22D 11/1243* (2013.01); *B22D 11/041* (2013.01); *B22D 11/055* (2013.01); *B22D 11/07* (2013.01)

(58) Field of Classification Search
CPC ..... B22D 11/124; B22D 11/055
(Continued)

(56) References Cited

U.S. PATENT DOCUMENTS 6,024,162 A 2/2000 Uehara et al.
8,899,304 B2 * 12/2014 Ansoldi ..... B22D 11/041 164/348
2014/0374971 A1 * 12/2014 Rinaldi ..... B22D 11/041 266/260

FOREIGN PATENT DOCUMENTS

EP 1792676 6/2007
EP 1795281 6/2007
(Continued)

*Primary Examiner* — Scott Kastler
(74) *Attorney, Agent, or Firm* — Hamre, Schumann, Mueller & Larson, P.C.

(57) ABSTRACT

Crystallizer for the continuous casting of long metal products such as blooms or billets, of the type cooled by an external cooling jacket, in which, at least in the zone of maximum thermal peak, positioned around the zone of the meniscus or immediately below it, there are means present, made on the walls of the crystallizer, to condition the heat exchange between the walls of the crystallizer and the cast steel. The means to condition the heat exchange comprise concavities or depressions made on the internal wall of the crystallizer, made around the zone of maximum thermal peak, and having a distribution that, in terms of the overall area occupied by them per surface unit, is reduced until it is canceled toward the bottom at a certain distance from said zone of maximum thermal peak.

16 Claims, 3 Drawing Sheets

(51) Int. Cl.
*B22D 11/055* (2006.01)
*B22D 11/07* (2006.01)

(58) Field of Classification Search
USPC ..... 164/478
See application file for complete search history.

(56) References Cited

FOREIGN PATENT DOCUMENTS

| | | |
|---|---|---|
| GB | 2177331 | 1/1987 |
| JP | 1170550 | 7/1989 |
| JP | 8206786 | 8/1996 |
| JP | 9225593 | 9/1997 |
| JP | 10296399 | 11/1998 |
| JP | 11000746 | 1/1999 |
| JP | 2001-105102 | 4/2001 |
| WO | WO 2008/017711 | 2/2008 |
| WO | WO 2008/017711 A1 * | 2/2008 |

* cited by examiner

CRYSTALLIZER FOR CONTINUOUS CASTING

FIELD OF THE INVENTION

The present invention concerns a crystallizer for the continuous casting of long metal products such as blooms or billets, cooled by an external cooling jacket.

The blooms or billets to which the crystallizer is preferentially applied have a square section with the length of the side equal to 120-180 mm, or rectangular with equivalent section.

BACKGROUND OF THE INVENTION

In the field of continuous casting, in particular in the case of casting blooms and billets, it is known that one of the main problems relating to the quality of the finished product is the defect of rhomboidity. This defect in shape is characterized by the fact that the products, such as blooms or billets, especially for small formats cast at high speed, at the end of the solidification downstream of the casting machine do not have a profile exactly equal to the internal section of the crystallizer, but assume a rhomboidal shape which can cause problems in the subsequent rolling processes.

If the rhomboidity, measured as the difference between the diagonals of the section, is more than 6 mm, then the frequency of blockages in the first rolling stands increases.

This detect in shape is usually generated because of the lack of uniformity of heat exchange in the crystallizer, in particular in the zone immediately below the meniscus, which causes an uneven thickness of skin on the perimeter, both between one side and the other of the product and also along the same side. This unevenness depends on an asymmetrical deformation of the crystallizer, the entity of which depends on the intensity of the heat flow. Once generated, the deformation increases and cannot be recovered.

Moreover, because of the large exchange surface the edges are subjected to a significant heat flow, unlike the zone at 0-30 mm from the vertex of the edge. The latter zone therefore has a smaller thickness of local skin than that of the rest of the billet. A skin with a non-homogeneous thickness has weak points where the thickness is less and the formation of cracks under the skin is therefore frequent which can cause breakouts.

This problem is even more accentuated when free casting is done using oil as the lubricant. On the other hand, if lubrication powders are used during casting, the rhomboidity is less accentuated thanks to the insulating effect of the powders and their homogeneous distribution; however, the use of powders is more costly compared to the use of oil and is therefore uneconomic when commercial steels are being produced.

Moreover, the problem increases as the casting speed increases, which puts a limit on the maximum speeds obtainable and therefore on the productivity of the casting machine.

Rhomboidity is therefore a defect in shape due to uncontrolled conditions of adhesion between the liquid steel and internal walls of the crystallizer for a certain segment below the meniscus, that is at the moment when there is the greatest heat exchange and coinciding with the formation of the first skin, in which a non-uniform heat exchange occurs, and therefore a difference in thickness of the skin which is created along the perimeter of the billet as it solidifies.

In order to solve the problem of rhomboidity, document U.S. Pat. No. 6,024,162 proposes to make, on the internal walls of the crystallizer, a regular series of concavities, with the function of rendering the heat exchange more uniform in the critical zone just below the meniscus.

In particular, a zone comprised between 20 and 200 mm below the nominal level of the meniscus is identified in which regular rows of concavities are made, in the form of horizontal grooves, or small depressions of a circular, square or hexagonal shape.

This solution, even if it is an improvement, does not solve the problem on the one hand because the distribution of the concavities is not correlated to the development of the heat flow, and on the other hand because said concavities by themselves worsen the problem of the cracks under the skin and the breakouts in the more critical cases of free casting at high speed and using oil as a lubricant. Indeed, the concavities reduce the total heat flow exchanged between steel and ingot mold and therefore the average thickness of the skin at exit from the ingot mold.

Documents JP 8-206786 A and JP 11-000746 A describe crystallizers with grooves made substantially in the central part of the internal wall in order to reduce the heat exchange in the zone immediately below the meniscus. These solutions only partially reduce the problem, since in any case they create a lack of homogeneity of heat treatment on the entire perimeter of the billet.

From documents EP 1,792,676 A1, EP 1,795,281 A2, GB 2,177,331 A and JP 9-225593 A it is also known to make grooves on the external walls of a crystallizer. However, the grooves are provided either on the whole face of the crystallizer or in its central zone, and they are not therefore intended to homogenize the cooling treatment in combination with other means operating in correspondence with the zone of the meniscus.

The Applicant has devised, tested and embodied the present invention to solve the problems of the state of the art and to obtain other advantages as shown hereafter.

SUMMARY OF THE INVENTION

The present invention is set forth and characterized in the independent claim, while the dependent claims describe other characteristics of the invention or variants to the main inventive idea.

One purpose of the present invention is to obtain a crystallizer for continuous casting which allows to homogenize the heat exchange, and hence the solidification of the steel, on the whole perimeter of the product, in particular in the zone below the meniscus where there is the peak of the thermal flow between the walls of the crystallizer and the cast steel.

Another purpose of the invention is to reduce to a minimum the rhomboidity of the cast products, such as blooms or billets, without radically modifying the basic structure of conventional crystallizers cooled by water circulating in an external jacket and without limiting the casting speed.

Another purpose of the invention is to reduce the formation of cracks under the skin and the consequent occurrence of breakouts at the exit from the crystallizer.

According to the present invention, the crystallizer for continuous casting has means to make the heat exchange uniform in the zone where the heat flow between the walls of the crystallizer and the cast steel has a peak, which, as we said, is typically that at the level of the meniscus or immediately below the meniscus.

In particular, the crystallizer according to the present invention has means to make the heat exchange uniform in this zone, trying to reduce said peak in order to be able to reduce the differences in thickness of the first skin which forms in the zone immediately below the meniscus.

Said means have the double function of creating, in the zone below the meniscus, contact resistances on the internal faces of the walls of the crystallizer, so that not all the contact surface between the copper and the steel is a useful surface for heat exchange; at the same time, however, according to an advantageous feature of the invention, it is provided to increase the contact surface, and therefore the heat exchange surface, in correspondence to the external faces of the walls of the crystallizer, in proximity to the edges, in this way compensating the tendency that the skin has to detach from the internal faces of the crystallizer.

According to the present invention, therefore, in a first feature, the crystallizer has concavities or depressions made on the internal face of the corresponding wall of the crystallizer, in particular in a substantially central zone of the corresponding face; said concavities and depressions have the function of interposing air, which acts as an insulator, between the liquid steel and the crystallizer, and therefore limiting the useful heat exchange surface.

Said concavities or depressions are preferably made immediately below the nominal level of the meniscus and have a distribution which, in terms of overall area occupied by them per surface unit, is reduced until it is canceled at a certain distance from said nominal level.

The progressive reduction of the overall area occupied by the concavities/depressions is made to follow and substantially adapt to the development of the intensity of temperature on the internal faces of the crystallizer, as will be explained in greater detail hereafter in the description.

In combination with said concavities/depressions made on the internal faces of the crystallizer, and in order to allow a correct heat exchange also in proximity to the zone of the edges, the crystallizer according to the present invention comprises vertical grooves made on its external faces or surfaces, in the zones near the edges, for a vertical extension greater than the vertical extension of the concavities/depressions made on the internal surfaces.

The function of the grooves is to increase the heat exchange between the wall of the crystallizer and the liquid steel in the end segment of the walls affected by the lack of contact between the steel and the crystallizer.

The presence of the grooves on the external surface of the walls of the crystallizer allows to increase the heat exchange surface, and also to reduce the distance between the liquid metal and the cooling fluid which flows on the external surface of the crystallizer. The transverse distance between the beginning of the zone with internal concavities and the end of the one with external grooves is such as to prevent a sudden variation of heat flow and therefore an increase in cracks under the skin which could evolve into breakouts.

According to the present invention, therefore, the crystallizer has both concavities/depressions made on the internal faces of the walls, the purpose of which is to reduce the peak of heat flow, and grooves made in the lateral zones of the external faces, the purpose of which is to increase the heat flow in the zones near the edges. The combined and synergistic action of both these arrangements allows to "flatten" and make uniform the heat flow along the walls in the zone below the meniscus.

In particular, the optimal uniformity of the heat flow is obtained thanks to the combined effect of the concavities/depressions on the internal face and in the substantially central zone of the wall of the crystallizer, and of the grooves on the external face and in the substantially lateral zone, near the edges, of the same wall of the crystallizer. In this way, the two effects compensate and integrate each other, giving as a result a homogenization of the cooling, and therefore the solidification of the skin, over the entire perimeter of the billet.

The advantage obtained is that of improving the final quality of the product in terms of shape, preventing the rhomboidity of the square/rectangular section and preventing the formation of cracks which could cause breakouts.

BRIEF DESCRIPTION OF THE DRAWINGS

These and other characteristics of the present invention will become apparent from the following description of one form of embodiment, given as an example with reference to the attached drawings wherein.

DESCRIPTION OF SOME EXAMPLE FORMS OF EMBODIMENT

Figure 1:
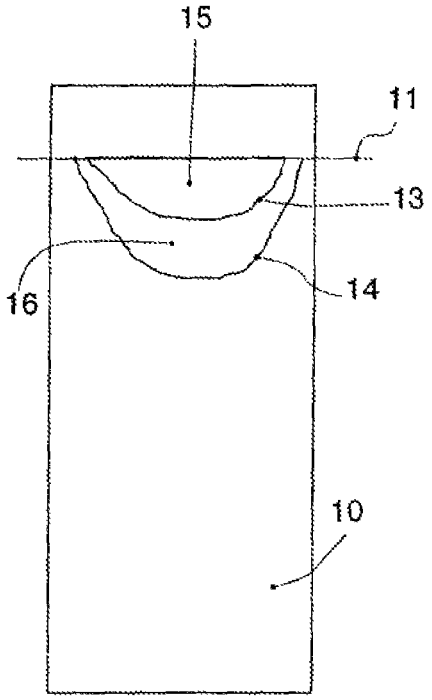
FIG. 1 schematically shows the development of the isotherms in the zone immediately below the meniscus.

A crystallizer 10 for the continuous casting of long products is shown schematically in FIG. 1, where the reference number 11 substantially indicates the nominal line of the meniscus of liquid metal.

In a crystallizer 10 of this type, for long products such as blooms or billets 12, of a polygonal shape, preferably quadrangular, even more preferably rectangular or square, with thin walls and cooled by means of an external jacket, the isotherm lines (at equal temperature) on the internal surface of the crystallizer 10 have, a development of the elliptical or parabolic type, like the lines 13 and 14 shown in FIG. 1.

In particular, the region indicated by the reference number 15 is that which has the maximum temperatures because it corresponds to the region of the meniscus; on the contrary, the adjacent region indicated by the reference number 16, comprised between the two isotherm lines 13 and 14, has lower temperatures.

Figure 2:
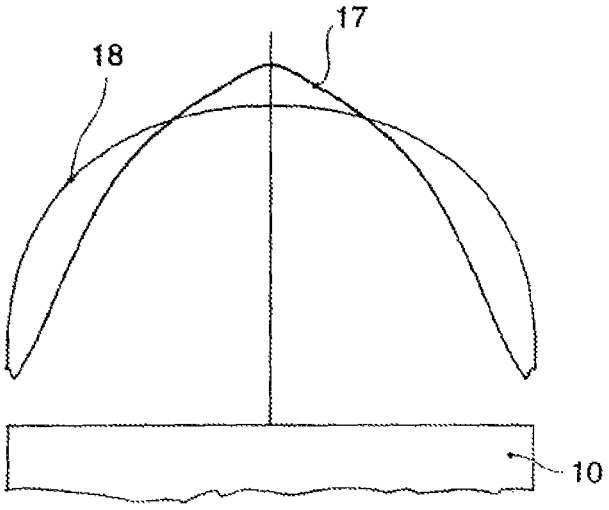
FIG. 2 schematically shows, in section, the development of the heat flow along one face of the crystallizer in the zone immediately below the meniscus.

In FIG. 2 the development of the heat flow along one face of the crystallizer 10 just below the meniscus 11 is shown in cross section; the thicker line 17 shows the (qualitative) development of the heat flow in conventional crystallizers, in which there is a strong peak at the center of the face and a clear drop toward the corners, caused by the progressive detachment of the skin front the wall of the crystallizer 10. In correspondence to the edges, the heat exchange increases again, even if only slightly, since the edge is cooled by both the sides.

On the other hand the thinner line 18 represents the qualitative development of the heat exchange to be obtained with the crystallizer 10 according to the present invention.

As will be seen more specifically hereafter, the presence of the concavities/depressions, generically indicated by 20 in FIGS. 3*a*, 3*b*, 4*a* and 4*b*, on the internal faces of the walls of the crystallizer 10, allows to reduce the heat flow at the center of the wall, while the simultaneous and combined presence of the grooves, generically indicated by 30, on the external faces, allows to increase the heat flow in the zones near the edges. This determines, overall, a more uniform development and consequently the formation of a skin with a more homogenous thickness.

Figure 3A:
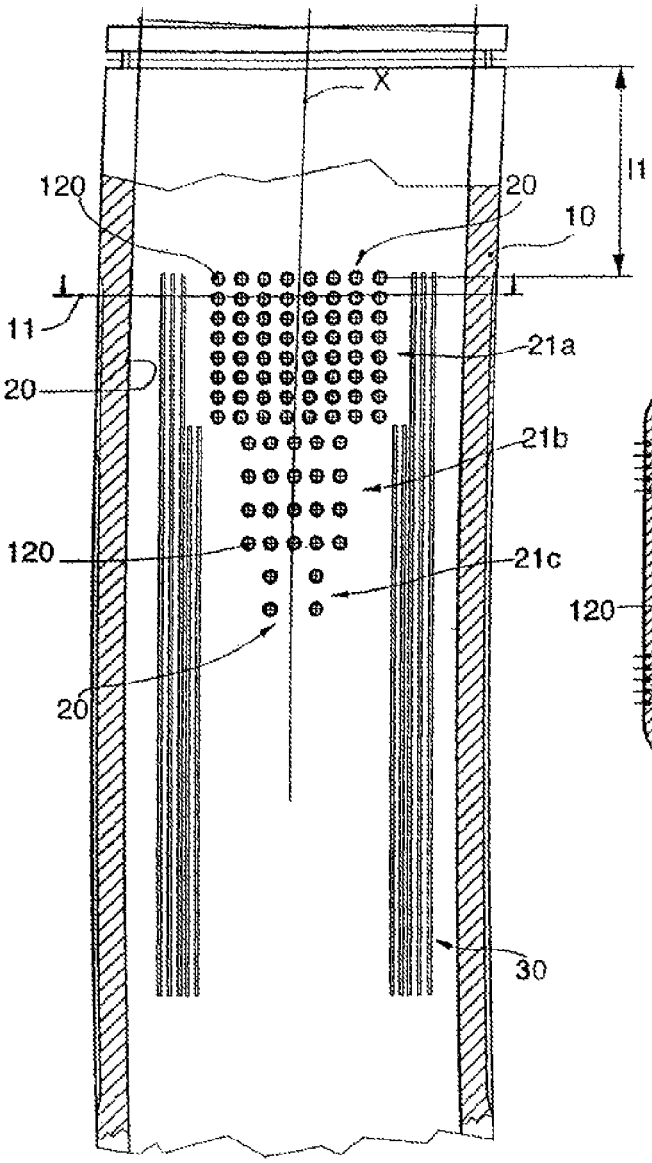
FIGS. 3*a* and 3*b* respectively show the longitudinal section and the cross section of a first form of embodiment of the present invention.
Figure 3B:
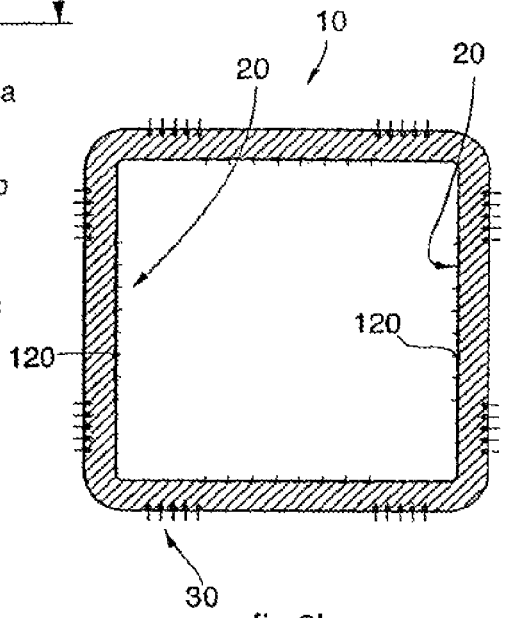

With reference now to the first form of embodiment shown in FIGS. 3*a* and 3*b*, a crystallizer 10 according to the invention for casting billets 12, in this case with a square section, is shown in longitudinal and cross section.

In this case, on the four internal faces of the walls of the crystallizer 10 there are concavities of a circular shape, or small blind holes 120, distributed according to a decreasing development and gradually thinning toward the bottom, in terms of overall area occupied per surface unit of the corresponding wall, so as to substantially reproduce the development of the density of heat flow on the corresponding face of the crystallizer 10.

In particular, in the case shown, in the substantially central zone of the corresponding face, there are three sectors, respectively indicated as 21*a*, 21*b* and 21*c*, in which the number of holes 120 disposed on a horizontal row is respectively lower, since the holes 120 are disposed substantially symmetrically with respect to the median longitudinal line X of the wall of the crystallizer 10.

In this way, the overall area occupied by the concavities/depressions 20 per surface unit of the wall, and therefore the contact resistance generated by them, is progressively reduced going down along the crystallizer 10 starting from the zone immediately below the meniscus 11, following and substantially trying to adapt to the development of the heat flow shown in FIG. 2.

In this way, the effect of homogenizing and rendering as uniform as possible said heat exchange along the entire perimeter of the billet 12 is achieved.

In the specific case shown in FIG. 3*a*, the holes 120 start at a distance 11 comprised between 100 and 140 mm, advantageously between 120 and 130 mm, from the top of the crystallizer 10, that is between about 20 and 30 mm below the meniscus 11, which is generally positioned about 100 mm from the top. The holes 120 end at a distance comprised between 200 and 500 mm from the top of the crystallizer 10, also depending on the overall length of the crystallizer 10.

In the example shown, the first sector 21*a* provides eight rows, each made up of eight circular holes 120, with a diameter which can vary from 4 to 12 mm, a depth which can vary from 0.2 to 0.8 mm, a horizontal pitch which can vary from 6 to 15 mm and a vertical pitch which can vary from 5 to 15 mm.

The surface of the hole 120 cannot be too extensive because the surface quality of the billet 12 would be affected by it. The depth of the holes 120 must also be reduced, so that the imprints of the holes 120 do not remain on the surface of the billet 12 exiting from the crystallizer 10.

In the example shown, the second sector 21*b* consists of holes 120 of the same size and with the same horizontal pitch, but with a different number and distribution: four rows each made up of five holes distanced by a bigger vertical pitch than that of the vertical pitch of the first sector 21*a*. Finally, the third sector 21*c* comprises two rows, each comprising two holes 120 with a bigger horizontal pitch than the horizontal pitch of the holes of the first and second sector 21*a* and 21*b*.

The representation shown in FIG. 3*a* is obviously merely an example, to represent the concept of substantially central and symmetrical disposition, as well as progressive reduction of the area occupied by the holes 120, per surface unit, to adapt to the development of the heat flow, along the walls of the crystallizer 10.

Figure 4A:
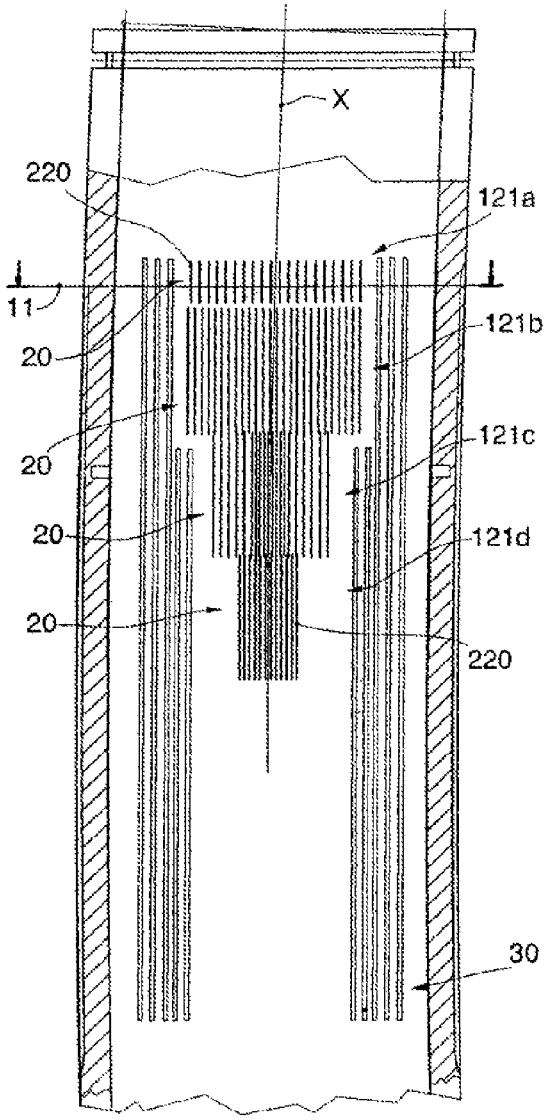
FIGS. 4*a* and 4*b* respectively show the longitudinal section and the cross section of a second form of embodiment of the present invention.
Figure 4B:
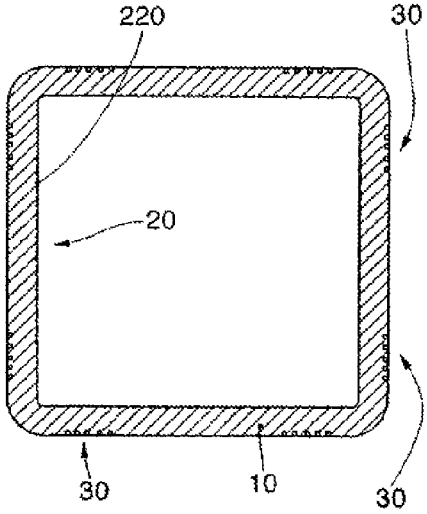

FIGS. 4*a*-4*b* show another possible form of embodiment, in which the circular holes 120 are replaced by vertical grooves 220.

As seen before, the vertical grooves 220 also have a distribution, divided in this case into four sectors 121*a*, 121*b*, 121*c*, and 121*d*, which substantially reproduces the development of the heat flow in the corresponding part of the wall, having a greater area occupied per surface unit in correspondence to the heat peak, a little below the meniscus 11, which then decreases as it moves downward along the walls of the crystallizer 10 until it is canceled at a certain distance from the meniscus 11.

According to variant embodiments, also horizontal grooves, oval holes, holes with a quadrangular or polygonal shape in general, also not regular, or any other suitable shape, can be made to obtain the concavities/depressions 20 according to the distribution indicated.

In addition and in cooperation with the concavities/depressions 20 there are also grooves 30 on the external faces of the walls of the crystallizer 10 which, in the case shown in FIGS. 3*a* and 4*a*, have a substantially vertical development.

As can be seen in said figures, the external grooves 30 begin substantially at the same height as the holes 120 (or the grooves 220) and increase in number, from three to five for each side of the face, in correspondence to the passage from the first sector 21*a* of internal holes to the second sector 21*b* (or from the second sector 121*b* of grooves 220 to the third sector 121*c*).

Thanks to this configuration, with an effect of synergy and combination with the holes/grooves present on the internal faces, the external grooves 30 allow to increase the heat exchange at the sides when the skin of the billet being formed has a greater tendency to detach from the corresponding wall of the crystallizer 10.

The grooves 30 can preferentially have a depth comprised between 1.5 and 4 mm, a pitch comprised between 4 and 10 mm and a width comprised between 1 and 4 mm.

In particular, the grooves 30 occupy a zone comprised, starting from the edge, between 5% and 25% of the size of the side of the billet in the casting step. For example, if one side of the crystallizer 10 has a size of 160 mm, the grooves 30 occupy, on both sides, a band comprised between 8 and 40 mm from the edge.

The grooves 30 can continue along the whole height of the crystallizer 10 or alternatively can be interrupted before, as shown in FIGS. 3*a* and 4*a*. However, they continue at least as far as the lower level of the internal holes 20, advantageously beyond the position of the internal holes 20, in order to maintain the homogeneity of heat flow and therefore the thickness of skin at exit from the ingot mold on the corresponding face of the crystallizer 10.

In general, since they are not in direct contact with the liquid steel cast, and in relation to the function which they have to carry out, the grooves 30 have a greater depth than that of the internal holes 20.

It is clear that modifications and/or additions of parts may be made to the crystallizer for continuous casting 10 as described heretofore, without departing from the field and scope of the present invention.

The invention claimed is:

1. A crystallizer for continuous casting of long metal products, of the type cooled by an external cooling jacket, and with a polygonal section shape, in which, immediately below a zone of a meniscus, there are means present, made on a wall of the crystallizer, to condition heat exchange between the wall of the crystallizer and a cast steel, wherein said means to condition the heat exchange comprise:

concavities or depressions made on an internal face of the wall of the crystallizer, wherein the concavities or depressions have a distribution that, in terms of an overall area occupied by them per surface unit, is reduced until the distribution of the concavities or depressions is canceled toward a bottom of the crystallizer at a certain distance from the meniscus; and vertical grooves made on external surfaces, in zones near edges of the polygonal section shape, having a vertical extension equal to or more than a vertical extension of the concavities or depressions.

2. The crystallizer as in claim 1, wherein said concavities or depressions begin at a distance comprised between 100 and 140 mm from a top of the crystallizer and end at a distance comprised between 200 and 500 mm.

3. The crystallizer as in claim 1, wherein said vertical grooves occupy a zone comprising, starting from corresponding one of the edges, between 5% and 25% of a side of one of the long metal products.

4. The crystallizer as in claim 1, wherein said concavities or depressions consist of small blind holes.

5. The crystallizer as in claim 1, wherein said concavities or depressions consist of vertical grooves.

6. The crystallizer as in claim 1, wherein said concavities or depressions consist of horizontal grooves, oval holes, holes of a quadrangular shape or polygonal shape.

7. The crystallizer as in claim 1, wherein said concavities or depressions are distributed in at least two distinct sectors, where a number of concavities or depressions present per surface unit on a horizontal row is substantially the same for every sector but decreases from one sector to other going toward the bottom of the crystallizer starting from said zone of maximum thermal peak.

8. The crystallizer as in claim 1, wherein said concavities or depressions are disposed substantially symmetrically with respect to a median longitudinal line of the wall of the crystallizer.

9. The crystallizer as in claim 1, wherein said concavities or depressions have a maximum depth of around 0.8 mm.

10. The crystallizer as in claim 3, wherein said vertical grooves substantially begin at a same height as said concavities or depressions and increase in number in correspondence with a passage from a first to a second sector of said concavities or depressions.

11. The crystallizer as in claim 3, wherein said vertical grooves have a depth comprised between 1.5 and 4 mm.

12. The crystallizer as in claim 3, wherein said vertical grooves extend at least beyond the position of said concavities or depressions.

13. The crystallizer as in claim 3, wherein said vertical grooves have a pitch comprised between 4 and 10 mm and a width comprised between 1 and 4 mm.

14. The crystallizer as in claim 1, wherein the polygonal section shape is quadrangular.

15. The crystallizer as in claim 1, wherein the polygonal section shape is rectangular.

16. The crystallizer as in claim 1, wherein the polygonal section shape is square.

* * * * *